US011987999B2

(12) United States Patent
Poon

(10) Patent No.: US 11,987,999 B2
(45) Date of Patent: May 21, 2024

(54) SUPPORT HEAD WITH QUICK RELEASE FOR FORMWORK SYSTEM

(71) Applicant: Brand Shared Services LLC, Kennesaw, GA (US)

(72) Inventor: Jack Yue Ho Poon, Ontario (CA)

(73) Assignee: Brand Shared Services LLC, Kennesaw, GA (US)

( * ) Notice: Subject to any disclaimer, the term of this patent is extended or adjusted under 35 U.S.C. 154(b) by 372 days.

(21) Appl. No.: 17/375,621

(22) Filed: Jul. 14, 2021

(65) Prior Publication Data

US 2023/0012935 A1 Jan. 19, 2023

(51) Int. Cl.
*E04G 11/48* (2006.01)

(52) U.S. Cl.
CPC ..... *E04G 11/483* (2013.01)

(58) Field of Classification Search
CPC ..... E04G 11/48; E04G 11/483; E04G 11/486
See application file for complete search history.

(56) References Cited

U.S. PATENT DOCUMENTS

| | | | | |
|---|---|---|---|---|
| 4,752,057 | A | 6/1988 | Hagemes | |
| 5,160,109 | A | 11/1992 | de Leeuw | |
| 10,053,875 | B1 | 8/2018 | Baron et al. | |
| 10,053,877 | B2 * | 8/2018 | Lenkin | E04G 11/483 |
| 10,407,925 | B2 | 9/2019 | Baron et al. | |
| 10,487,521 | B2 | 11/2019 | Baron et al. | |
| 11,384,546 | B2 * | 7/2022 | Becker | E04G 11/486 |
| 11,603,673 | B2 * | 3/2023 | Haeberle | E04G 25/04 |
| 2007/0264076 | A1 | 11/2007 | McCracken | |
| 2009/0184230 | A1 | 7/2009 | Carney, Jr. | |
| 2018/0080238 | A1 | 3/2018 | Lenkin | |
| 2020/0217091 | A1 | 7/2020 | Haeberle et al. | |
| 2021/0079670 | A1 | 3/2021 | Becker | |

(Continued)

FOREIGN PATENT DOCUMENTS

| | | | | |
|---|---|---|---|---|
| CA | 2994076 | A1 | 8/2019 | |
| CA | 3030905 | A1 | 7/2020 | |
| DE | 3613075 | C * | 7/1987 | E04G 11/483 |

(Continued)

OTHER PUBLICATIONS

Translation of EP 0665348. (Year: 1995).*

(Continued)

*Primary Examiner* — Rodney Mintz
(74) *Attorney, Agent, or Firm* — DINSMORE & SHOHL LLP

(57) ABSTRACT

A support head mountable on a support post for supporting a beam in a formwork system is provided. The support head includes a top member for contacting and supporting the beam, a base member mountable on top of the support post, and a pin. Each of the top and base members has a tube with opposing pin holes. The tubes are configured to form vertically extending telescopic tubes, with the pin holes aligned along a horizontal axis. The pin is insertable into the pin holes, and has spaced apart depressions thereon. The pin is slidably moveable in the pin holes from a first position to a second position. In the first position, the depressions are offset from the pin holes. In the second position the depressions are aligned with the respective pin holes thus lowering the first tube and the top member in height.

20 Claims, 7 Drawing Sheets

(56) References Cited

U.S. PATENT DOCUMENTS

2023/0383556 A1* 11/2023 Haeberle ..... E04G 11/38

FOREIGN PATENT DOCUMENTS

| | | | | | |
|---|---|---|---|---|---|
| EP | 0665348 | A1 | | 8/1995 | |
| EP | 0957217 | A1 | | 11/1999 | |
| WO | WO-02084051 | A1 | * | 10/2002 | ..... E04G 11/38 |
| WO | 2011089148 | A1 | | 7/2011 | |
| WO | 2019156958 | A1 | | 8/2019 | |
| WO | 2020150539 | A1 | | 7/2020 | |

OTHER PUBLICATIONS

International Search Report and Written Opinion pertaining to International application No. PCT/US2021/041586 dated Oct. 21, 2021, 9 pages.

* cited by examiner

SUPPORT HEAD WITH QUICK RELEASE FOR FORMWORK SYSTEM

FIELD

The present disclose relates generally to formwork systems, and particularly to releasable support heads of formwork systems for supporting forming panels.

BACKGROUND

Formwork systems provide a temporary mold for curing liquid concrete therein or thereon to form concrete slabs or panels, often referred to as form panels. After the liquid concrete is cured, the formwork system may be removed, leaving behind a concrete structure. Formwork systems can be used for constructing or building different types of structures, such as buildings, bridges, parking garages, and so forth. The cured concrete slabs may be used to form ceilings or floors.

Typically, a formwork system has a number of upright support posts, also known as props, that support and uphold the mold while liquid concrete is poured into or onto the mold and while the concrete cures.

In some existing formwork systems, a head member of the support post, sometimes referred to as a drophead, includes a top support plate for supporting a formwork panel thereon, a middle part movable relative to the top support plate for supporting a beam in the formwork system, and a lowering device, such as a wedge, for lowering the middle part relative to the top support plate from an upper casting position to a lower stripping position. When the middle part is dropped to the stripping position, the top support plate remains in the same vertical position, for shoring the formwork panel in order to support the concrete slabs formed thereon.

The support posts may have an adjustable height. For example, a support post may have an upper section that can be lowered after the concrete has cured to allow removal of the support post. Typically, the upper section and a lower section of the support post is connected by a height adjustment mechanism such as a threaded connection, and the upper section can be raised or lowered by turning the threated connection. The concrete poured into the mold adds substantial weight on the support posts. Further, when liquid concrete cures, its volume expands. As a result, the cured solid concrete has a larger volume than the initial volume of the liquid concrete, which adds a substantial downward compression force on the support posts through the mold. The added weight and compression force applied to the thread surfaces increase the friction between the opposing threaded surfaces of the threaded connection, so it is more difficult to turn the threaded connection to lower the upper sections of the support posts after the concrete has cured.

It is thus desirable to provide improved supports for formwork systems.

SUMMARY

In an aspect, the present disclosure provides a support head that can provide quick release of support posts from the vertical load applied onto the support posts by formwork panels in a formwork system.

In accordance with an embodiment of the present disclosure, there is provided a support head mountable on a support post for supporting a beam in a formwork system. The support head comprises a top member for contacting and supporting the beam, comprising a first tube having opposing pin holes; a base member mountable on top of the support post, comprising a second tube having opposing pin holes, wherein the first and second tubes are configured to form vertically extending telescopic tubes with the pin holes aligned along a horizontal axis; and a pin insertable into the pin holes, the pin comprising spaced apart depressions thereon and being slidably moveable in the pin holes from a first position to a second position, wherein, in the first position the depressions are offset from the pin holes, and in the second position the depressions are aligned with the respective pin holes thus lowering the first tube and the top member in height.

In various embodiments, the depressions may comprise a pair of spaced apart grooves. The grooves may have a generally U-shaped profile, or a generally V-shaped profile. The grooves may have a depth of about 5 mm and a width of about 10 mm. The pin may comprise an elongated, generally cylindrical body. The cylindrical body may have a flat surface opposite to the depressions. A first end of the pin may comprises a guide portion and the top member of the support head may comprise a pair of guide plates for receiving the guide portion to orient the pin and prevent rotation of the pin, wherein the guide portion restricts axial movement of the pin in the pin holes and prevents disengagement of the pin from the pin holes at the first end. The support head may further comprise a cotter pin, wherein a second end of the pin comprises a pin hole for receiving the cotter pin, and wherein the cotter pin when received in the pin hole of the release pin restricts axial movement of the pin and prevents disengagement of the pin from the pin holes at the second end. The pin may be made of steel and may have an electroplated surface.

In various embodiments, the top member of the support head may comprise a main plate and at least one of a support arm and a support peg on top of the main plate, and the first tube may extend downward from the main plate. The base member may comprise a base plate and a latch mounted below the base plate for engaging the support post, wherein the second tube may extend upward from the base plate.

In some embodiments, when assembled and installed during use, the depressions of the pin may face upwards. In some embodiments, the depressions may face downwards when installed.

In another embodiment, there is provided a support head comprising a base member configured to couple to a support post, the base member comprising opposing walls extending upwardly; a top member comprising at least one arm or peg for supporting a beam thereon and opposing walls extending downwardly; wherein each one of the opposing walls has a pin hole thereon and the pin holes in the opposing walls are aligned along a horizontal axis; and a pin slidably received in the pin holes, the pin having a longitudinal axis aligned with the horizontal axis and comprising depressions extending transversal to the longitudinal axis, wherein the pin is slidably moveable within the pin holes from a first position to a second position such that in the first position, the depressions are offset from the opposing walls and the top member is supported by the pin at a first, higher height, and in the second position, the depressions are aligned with the opposing walls and the top member is supported by the pin at a second, lower height. The base member may comprise an upwardly extending tube and the top member may comprise a downwardly extending tube. The tubes may form a pair of telescopic tubes, and the opposing walls may be walls in the corresponding tubes.

In a further embodiment, there is provided a vertical support for a formwork system. The vertical support comprises a support post and a support head as described herein.

Another embodiment relates to a formwork system. The system comprises a plurality of vertical supports, at least one of which is the vertical support described above. The system may further comprise a plurality of beams, each one of which is supported by at least two of the vertical supports through the support heads thereof.

In another aspect, there is provide a method of supporting formwork panels with a formwork system as described herein. The method comprises: setting the pin in each one of the support heads of the formwork system at the first position; disposing one or more formwork panels on the beams of the formwork system; forming concrete slabs on the formwork panels; striking the pin in a first support head to move the pin to the second position so as to lower the top member of the first support head and an end of the beam supported thereon, thus releasing a vertical load applied onto the support post below the first support head to allow removal of the support post.

Other aspects, features, and embodiments of the present disclosure will become apparent to those of ordinary skill in the art upon review of the following description of specific embodiments in conjunction with the accompanying figures.

BRIEF DESCRIPTION OF DRAWINGS

In the figures, which illustrate, by way of example only, embodiments of the present disclosure.

DETAILED DESCRIPTION

Figure 1:
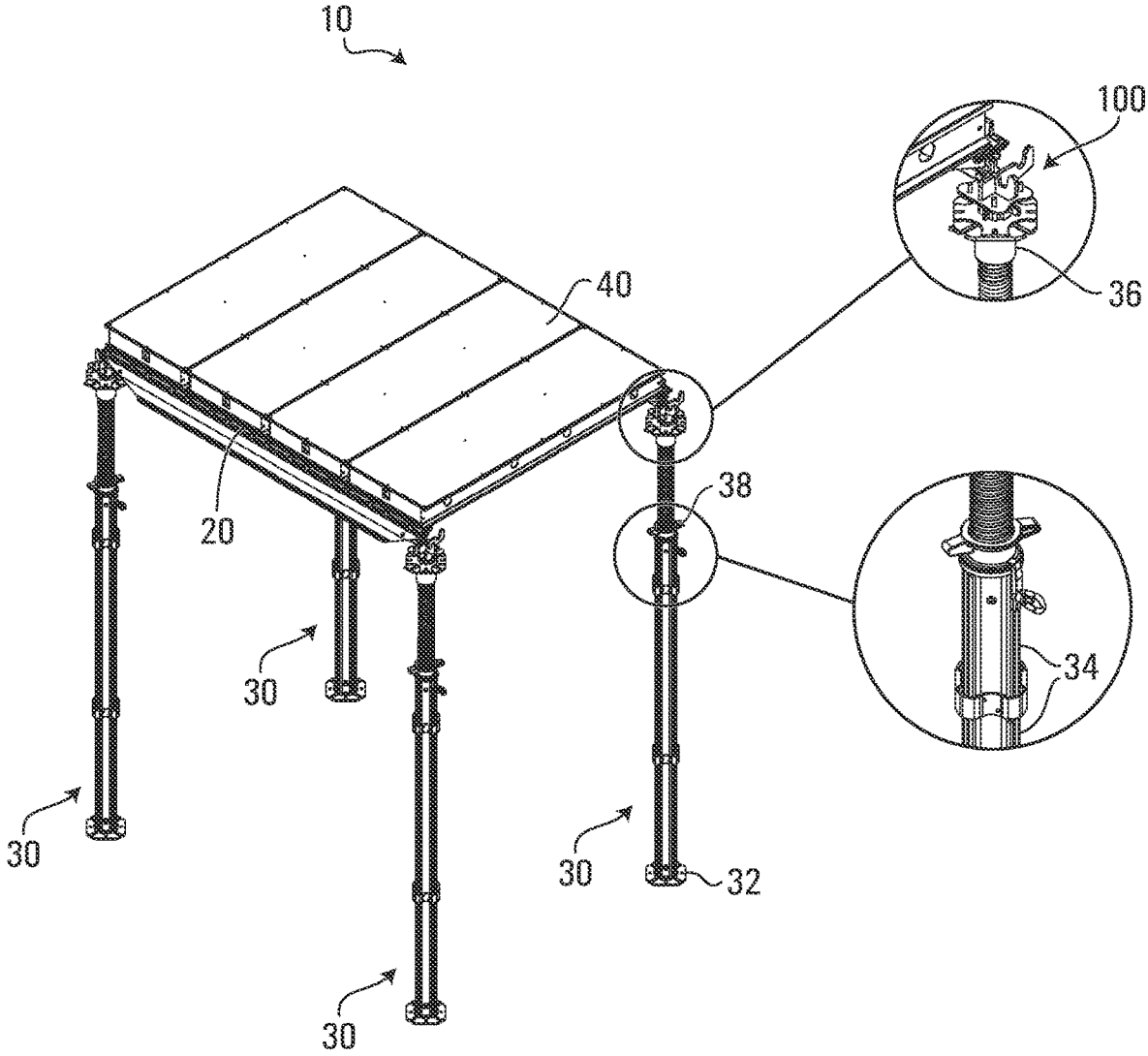
FIG. 1 is a perspective view of an example formwork system, in accordance with an example embodiment of the present disclosure.
Figure 2A:
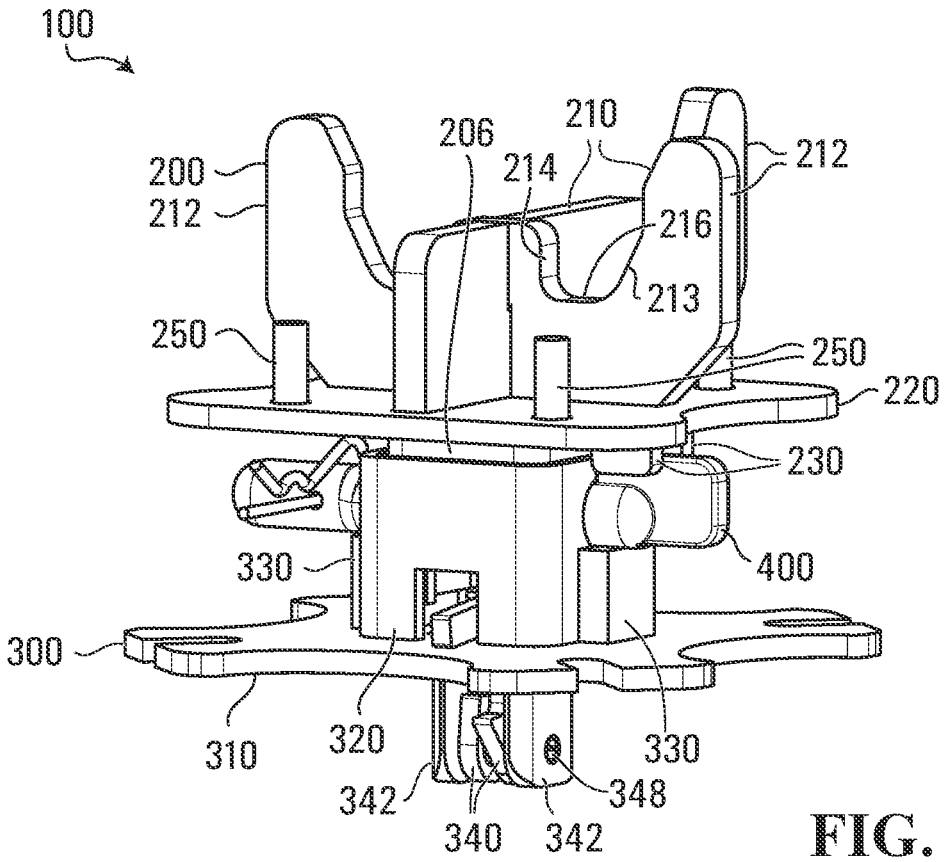
FIG. 2A is a first perspective view of a support head, in accordance with an example embodiment of the present disclosure.
Figure 2B:
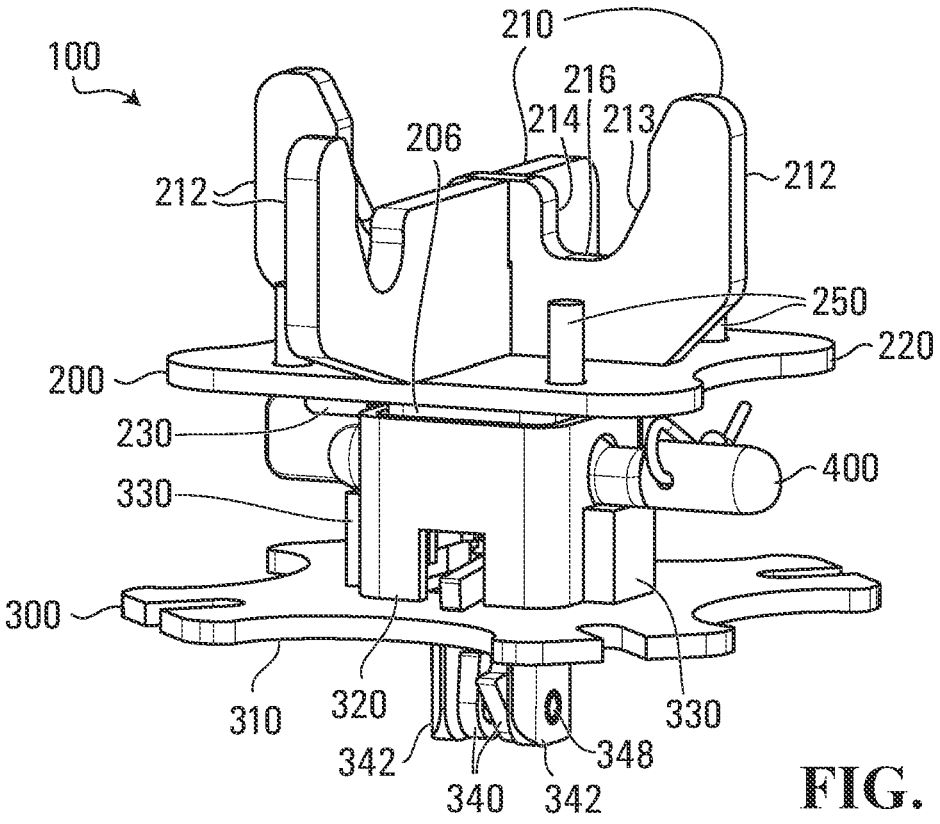
FIG. 2B is a second perspective view of the support head of FIG. 2A.
Figure 3:
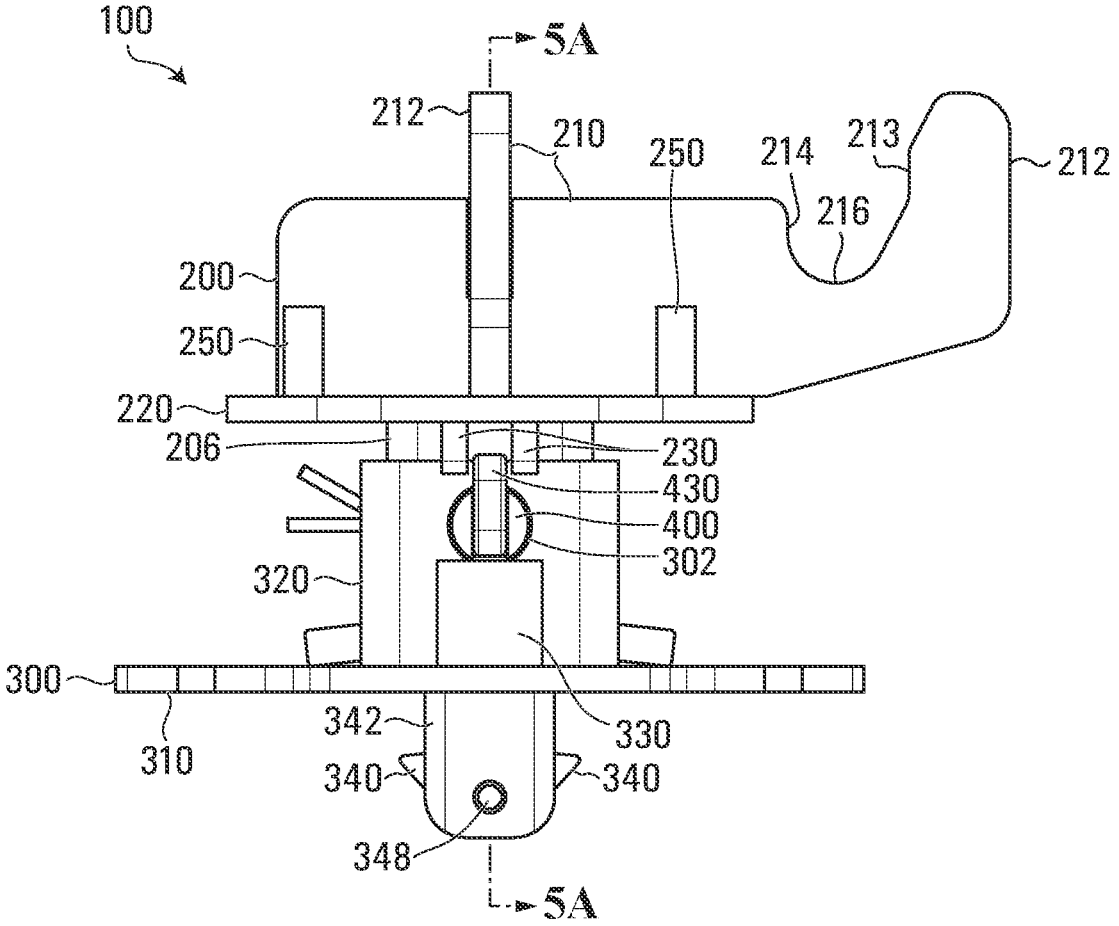
FIG. 3 is a side plan view of the support head of FIG. 2A.
Figure 4A:
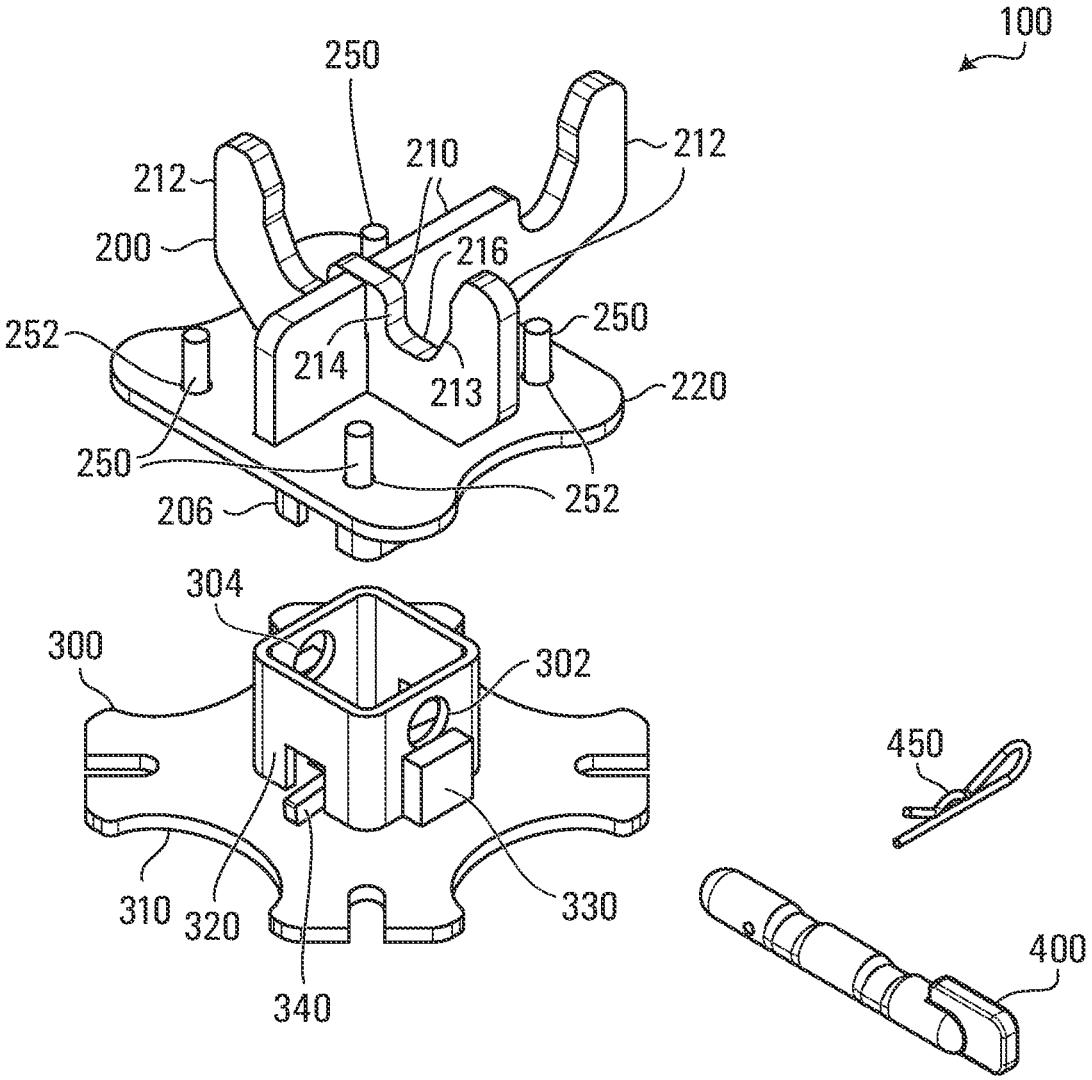
FIG. 4A is a top exploded view of the support head of FIG. 2A.
Figure 4B:
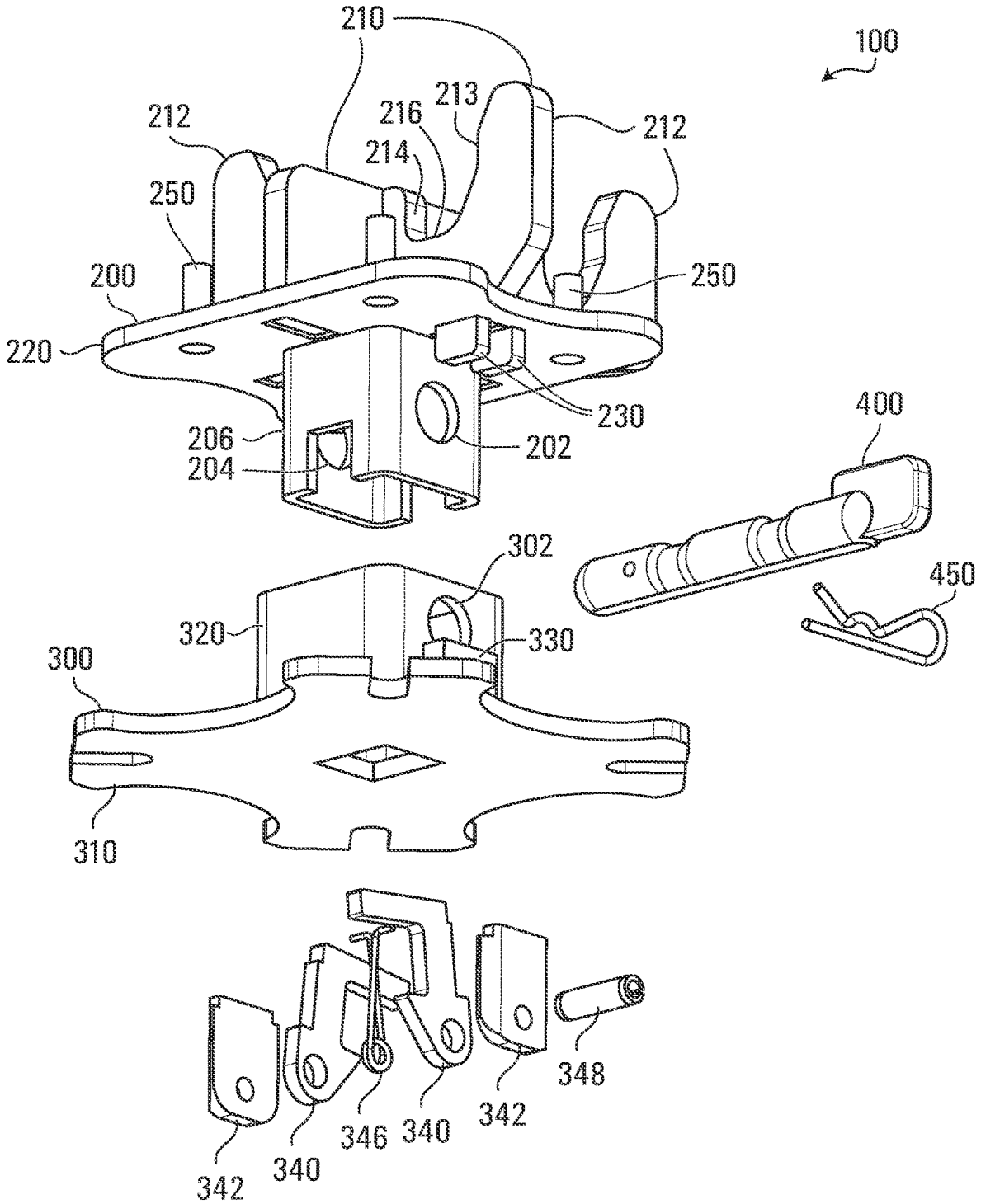
FIG. 4B is a bottom exploded view of the support head of FIG. 2A.

In brief overview, a support head with a release pin is disclosed for use in a formwork system. The support head is mountable on top of a support post in the formwork system for supporting a structure thereon. The release pin is configured to initially set a top member of the support head at a first, higher height, and subsequently lower the top member to a second, lower height, to release the vertical load applied on to the support head by the structure supported by the top member. The release pin is movable from an initial position to a release position to allow quick release of the vertical load applied to the support head when the pin is in the initial position. The support head is thus useful in formwork systems for quick release and convenient removal of support posts in a formwork system, such as after the concrete poured into formwork panels supported by the support posts has cured.

More specifically, in embodiments described herein, the top member of the support head is used to support an end of a beam in the formwork system, but the top member does not directly supports or contacts any structure, such as formwork panels or molds, supported on the beams of the formwork system. Thus, conveniently, when the top member of the support head drops in height after the release pin is moved to the release position, the supported end of the beam drops in height with the top member, and the end of the beam and the support head are both disengaged from the supported structure, such as the formwork panels, that is initially supported by the beams and indirectly by the support posts through the beams. Consequently, the support post is released from the vertical load of the supported structure and can then be conveniently removed.

In other words, the overall height of a vertical support including the support post and the support head is lowered when the release pin is moved to the release position, thus reducing the vertical pressure applied to the vertical support.

In embodiments described herein, the releasing pin has a relatively simple structure and can be easily moved from the initial position to the release position, such as by striking an end of the pin generally horizontally.

In comparison, in some conventional dropheads or support devices used in formwork systems, a wedge is used to lower only a middle part of the drophead, such that after the middle part is lowered, the downward load from the supported formwork panels is still applied to the top portion of the drophead and thus indirectly to the support posts below through the drophead. Some of such devices are disclosed in CA3030905, CA2994076, U.S. Ser. No. 10/053,875, U.S. Ser. No. 10/407,925, U.S. Ser. No. 10/487,521, US20180080238, US20200217091, and US20210079670. In these systems, it is not convenient to release the support posts from the vertical pressure, as movement of the wedge does not release the support posts from such vertical pressure.

In an example embodiment of the present disclosure, a formwork system 10 includes horizontal beams 20 and vertical support posts 30 for supporting form panels 40. Support heads 100 are provided on top of the support posts 30 to connect the support posts 30 to beams 20.

As can be appreciated by those skilled in the art, forming panels 40 provide a flat surface to pour liquid concrete thereon. The forming panels 40 thus provide a mold for curing the concrete to form concrete slabs. Forming panels 40 may be made of a light-weight material, such as aluminum, or an alloy. Forming panels 40 may have any suitable dimensions. For example, in an embodiment, a forming panel 40 may be 2 feet wide and 6 feet long. In other embodiments, forming panels may have different sizes, such as from 1 foot to 6 feet in length or width. In the same formwork system 10, the forming panels 40 may have the same or different sizes.

Beams 20 may be known beams suitable for use in formwork systems. As illustrated in FIG. 1, each end of the two ends of a beam 20 is supported by a support post 30 and rests on the support head 100 on top of the support post 30. In different embodiments, beams 20 may be in direct contact with support heads 100, or may be indirectly supported by support heads 100 through intermediate connections such as sockets, brackets or mounting pins as can be understood by those skilled in the art.

For example, as illustrated in FIG. 1, each end of a beam 20 may have a mounting pin (not separately shown). The beam 20 and the mounting pin may be constructed as disclosed in US 2021/0079670, the entire contents of which are incorporated herein by reference.

Each support post 30 may be height adjustable and include a lower base section 32, one or more optional middle sections 34, and an upper (top) section 36. The upper section 36 is configured to be raised or lowered by a height-adjusting mechanism, such as by turning a threaded connection 38 that connects the upper section 36 to a section below, which may be the base section 32 or a middle section 34. The construction and operation of support posts 30 may be the same or similar to those of known support posts for formwork systems. For example, support posts described in the following documents may be used: CA3030905, CA2994076, WO2020/150539, U.S. Ser. No. 10/053,875, U.S. Ser. No. 10/407,925, U.S. Ser. No. 10/487,521, US20180080238, US20200217091, or US 2021/0079670. The entire contents of each of CA3030905 and CA2994076 are incorporated here by reference. Other support posts with adjustable height for selectively raising and lowering the total height of the support posts may also be suitable for use within formwork system 10 and with support head 100.

A support post 30 may be used to support an end of one beam 20, or the ends of two or more beams 20. Each beam 20 may be supported by at least two support posts 30. Each support post 30 is adjustable in height so it may be adjusted to raise or lower the end(s) of the beam(s) 20 supported thereon as desired.

Two beams 20 may be arranged in parallel as illustrated in FIG. 1. In different embodiments, more than two beams 20 may be arranged in parallel to provide support for more forming panels 40. Some beams 20 may also be perpendicular to one another to provide additional support to the forming panels 40. Further, the structure shown in FIG. 1 may be repeated and multiple similar structures may be arranged side-by-side to expand the forming surface as desired.

A forming panel 40 may be supported by two or more beams 20. Further, additional horizontal beams (not shown) may be attached to and supported by the two parallel beams 20 shown in FIG. 1 so that each forming panel 40 is also supported by one or more of these additional horizontal beams to provide better support along the longitudinal direction of the forming panel 40.

The forming panels 40 may provide a forming surface that is generally horizontal or level. While beams 20 are sometimes referred to as horizontal beams 20, in different embodiments, beams 20 may be slightly inclined, or two parallel beams 20 for supporting the same forming panels 40 may be at different heights, so that the forming surface formed by the forming panels 40 may have sections that are inclined. Forming panels 40 may include formwork structures known as formwork panels, or sheets.

The construction and use of horizontal beams and vertical support posts to support and form concrete slabs in formwork systems are generally known to those skilled in the art, and are not the focus of this disclosure. Therefore, the beams 20 and support posts 30 will not be described in detail herein.

As illustrated in FIGS. 2A, 2B, 3, 4A and 4B, the support head 100 according to an embodiment of the present disclosure includes a top member 200 and a base member 300. The top member 200 and base member 300 are engaged through telescopic tubes 206, 320 by a release pin 400.

The top member 200 includes hook plates 210 mounted on top of a main plate 220. The hook plates 210 are configured to support thereon horizontal or inclined beams 20. Hook plates 210 can function as support arms or brackets for engaging and positioning an end of a beam 20.

On the top surface of the main plate 220, a number of pegs 250 are also provided, which may be used to support thereon a structure to be supported such as a beam 20. Pegs 250 may be mounted on the main plate 220 through peg holes 252.

Hook plates 210, main plate 220, and pegs 250 may be configured and constructed according to conventional techniques known to those skilled in the art. As can be appreciated, the hook plates 210 are configured to support at least two beams 20 at the same time. The two beams 20 may be oriented perpendicular to each other, or inline along the same general direction. Hook plates 210 may be configured and constructed as disclosed in US20210079670.

The top member 200 also includes a vertical tube 206 having four side walls (two pairs of opposing walls) mounted under the main plate 220. One pair of the opposing walls of tube 206 have pin holes 202, 204 thereon. The pin holes 202,204 are aligned along a horizontal axis. Pin holes 202, 204 of tube 206 are sized and positioned for receiving the release pin 400 and allowing the release pin 400 to slide therein. Two pin guides 230 are also mounted beside tube 206 for orienting and guiding the release pin 400, as will be further described below.

The base member 300 includes a base plate 310, which has a central opening for mounting a latch mechanism. A vertical tube 320 is mounted on the top surface of the base plate 310. Tube 320 has four side walls, including two pair of opposing walls, providing a channel between the tube walls. One pair of the opposing walls of tube 320 have aligned pin holes 302, 304 thereon, for receiving release pin 400 and allowing release pin 400 to slide therein.

The walls of tube 206 and tube 320 may have a thickness of about 5 mm.

In the depicted embodiment, tube 320 and tube 206 are sized and positioned so that tube 206 can be slidably received in the channel of tube 320 and the pin holes 202, 204, 302, 304 can be aligned along a horizontal axis to receive the release pin 400 therein. Tubes 206 and 320 can form a pair of telescopic tubes. Coupling of tubes 206 and 320 orients and positions the top member 200 with respect to the base member 300 and the support posts 30.

Base member 300 also includes a support plate 330 positioned outside tube 320 below each pin hole 302 or 304. Support plates 330 are configured and positioned to provide support for pin 400 when the pin is inserted into pin holes 302, 304. Thus, in some embodiments, the top surface of support plates 300 may be tangential to the circumference of each pin hole 302, 304, or flush with the lowest point in each pin hole 302, 304. However, in other embodiments, the top surface of support plate 330 may be slightly higher than the lowest point in pin hole 302, 304, such that the pin 400 may rest on top of the support plates 330 when the pin is received in pin holes 302, 304.

Base member 300 further includes a latching mechanism attached to the base plate 310 for connecting the support head 100 to the top section 36 of the support post 30. As depicted, the latching mechanism may include a pair of retaining latches 340, latch support plates 342, a latch spring 346, and a slotted pin 348. The latching mechanism may be configured and constructed according to a conventional technique and therefore will not be described in detail herein.

Figure 6:
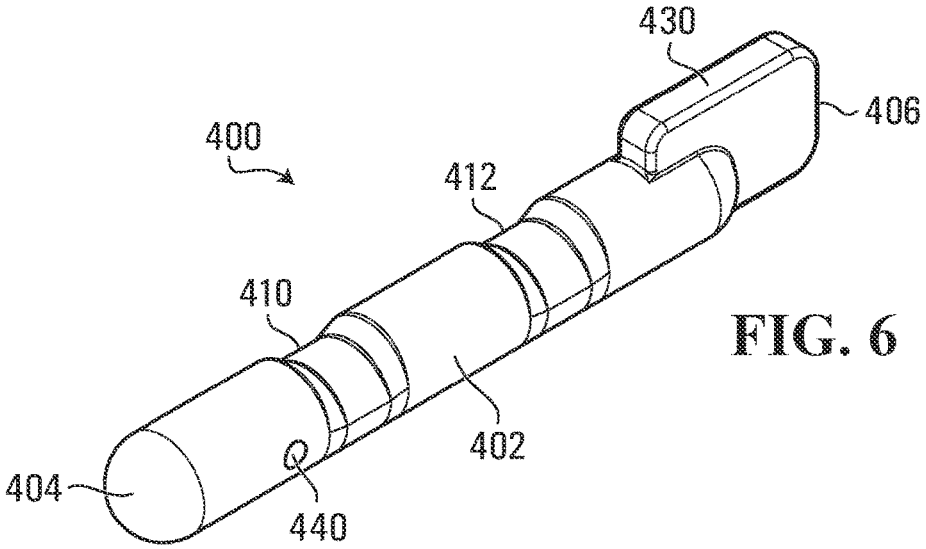
FIG. 6 is a top perspective view of the release pin in the support head of FIG. 2A.
Figure 7:
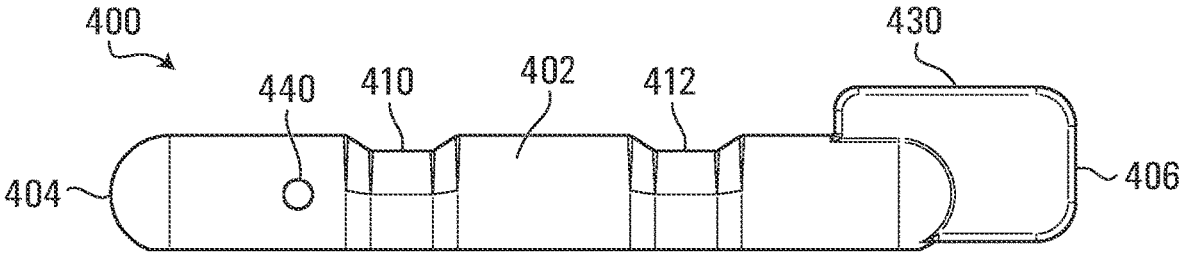
FIG. 7 is a side plan view of the release pin of FIG. 6.
Figure 8:
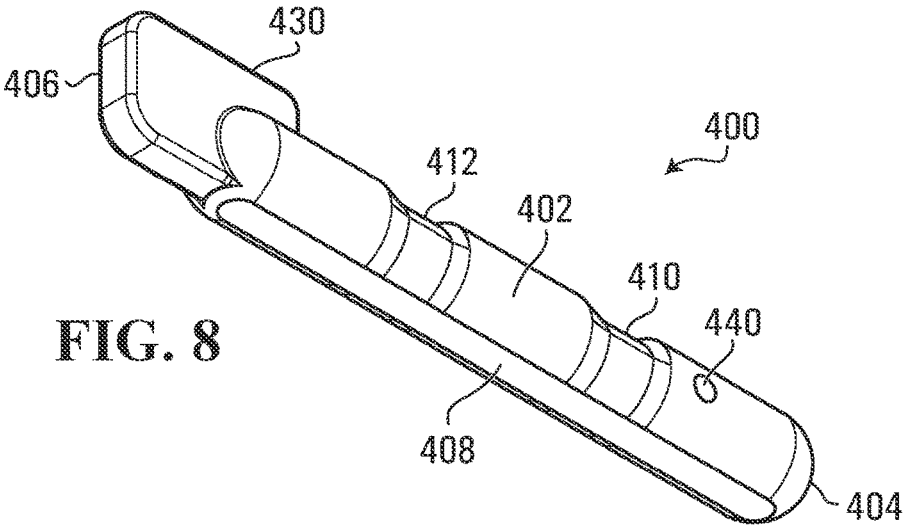
FIG. 8 is a bottom perspective view of the release pin of FIG. 6.

As better illustrated in FIGS. 6-8, where the release pin 400 is shown in isolation, release pin 400 has a generally cylindrical body 402, which is elongated in an axial direction, and has two transversally extending grooves 410 and 412 on one side of the body 402 and a flat surface 408 on the opposite side of body 402. As will be explained below, during use and when installed, the grooves 410 and 412 will face up and on the top side of the release pin 400 and the flat surface 408 will face down and on the bottom side of the release pin 400.

In the operation positions when release pin 400 is horizontally oriented and the grooves 410, 412 face upwards, the body 402 of release pin 400 are divided by grooves 410, 412 into five sections, including three sections beside the grooves having a top surface at a first height and two sections at the grooves with a top surface at a second height, which is lower than the first height, by the depth of the grooves. In some embodiments, the grooves 410, 412 may have a depth of about 5 mm and a width of about 10 mm at the bottom of the grooves. The grooves may have tapered sections each having a length of about 4 mm. In other embodiments, the depth of the grooves may vary but should be sufficiently large to provide an adequate drop in height of the top member 200 during use, as will be described further below. In some embodiments, the body 402 of release pin 400 may have a length of about 120 mm and a diameter of about 20 mm. The shape and dimensions of release pin may however vary depending on the application and the dimensions of the support heads in which the release pin is to be used.

Body 402 has a first end 404 and a second end 406. One or both of the ends 404, 406 of body 402 may have a hemisphere shape. At one of these ends 404, 406, such as end 406 as depicted in the drawings, a generally rectangular guiding block 430 is provided. Guide block 430 may be integrally formed with the cylindrical body 402, or fixedly mounted thereon such as by welding. For example, the releasing pin 400 including the guide block 430 may be formed of forged steel.

At the opposite end of body 402, such as end 404 as depicted in the drawings, a pin hole 440 is provided for insertion of a cotter pin 450. Cotter pin 450 functions as a security pin for securing the release pin 400 in place after the release pin 400 is inserted into the pin holes 202, 204, 302, 304 of the tubes 206, 320, and for preventing the release pin 400 from disengaging from the top and base members 200, 300 of the support head 100.

In example embodiments, when the cylindrical body 402 of the release pin 400 has an outer diameter of about 20 mm, the pin holes in tube 206 and tube 320 may have a diameter of about 21 mm.

The release pin 400 may be formed of steel and the surface of the release pin 400 may be electroplated.

Figure 5A:
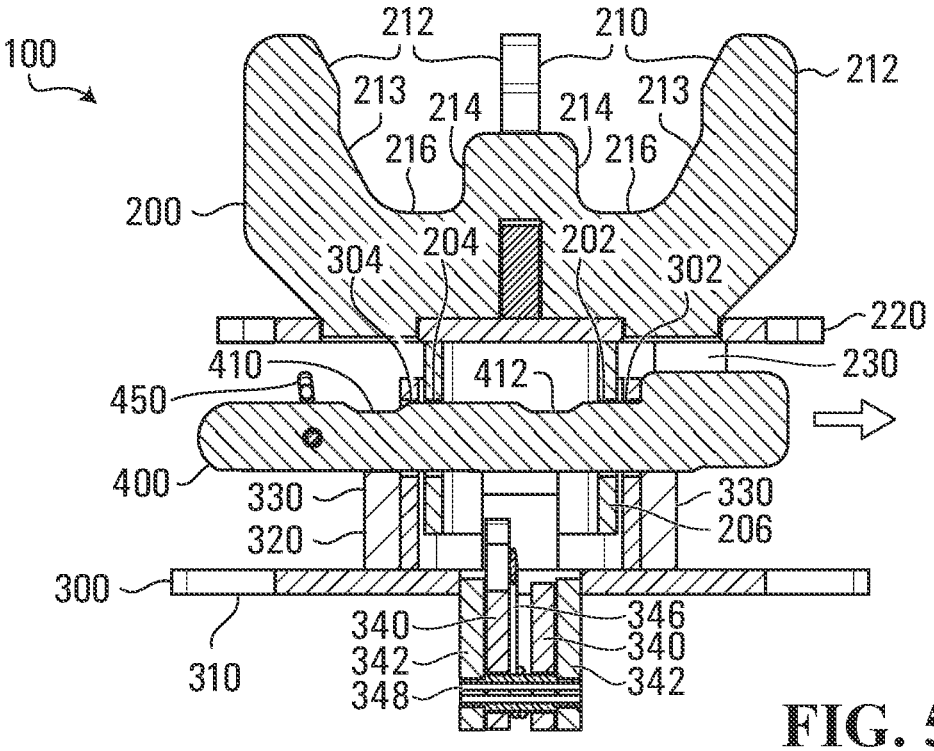
FIG. 5A is a cross-sectional view of the support head of FIG. 2A, along line 5A-5A, where the release pin is in a first (set) position.
Figure 5B:
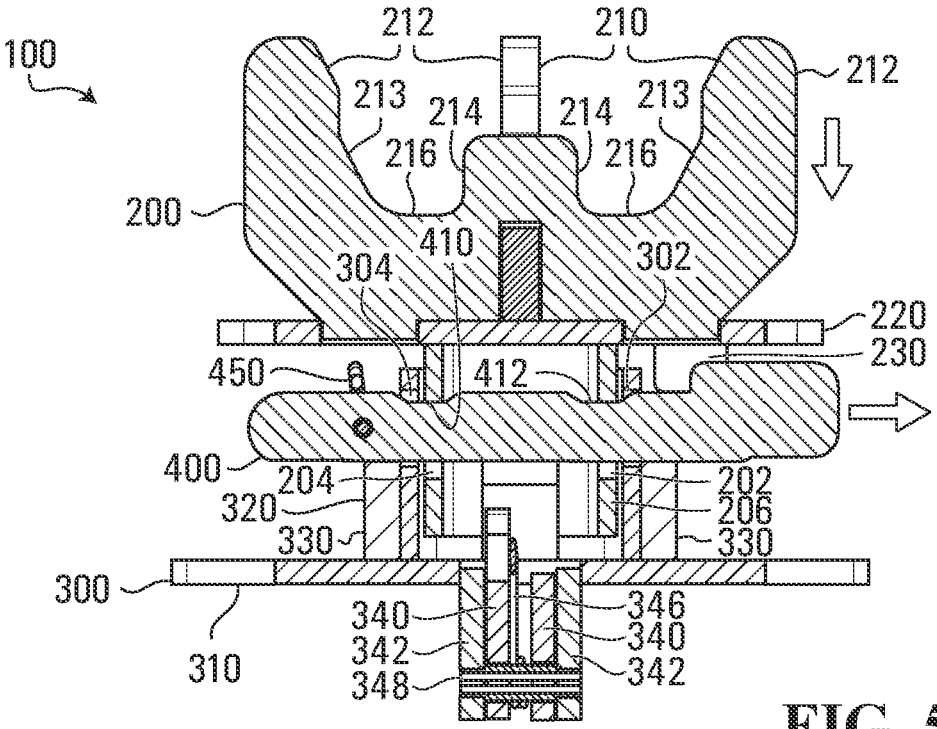
FIG. 5B is the same view as in FIG. 5A, but with the release pin in a second (release) position.

When the support head 100 is assembled, the release pin 400 can move between two positions, as illustrated in FIGS. 5A and 5B. In the first position as illustrated in FIG. 5A, the release pin 400 is positioned with respect to the tube 206 of top member 200, particularly the opposing walls having pin holes 202 and 204, such that the two opposing walls both contact the release pin 400 at two contact points outside the grooves 410, 412, so the top member 200 is at a higher height (first height). That is, at the first position, the grooves 410, 412 of pin 400 are horizontally offset from the pin holes 202, 204 of the tube 206. When the release pin 400 is slid to the second position as illustrated in FIG. 5B, the grooves 410, 412 are aligned with pin holes 203, 204, i.e., groove 410 and the wall with pin hole 202 are generally in the same vertical line, and groove 412 and the wall with pin hole 204 are generally in the same vertical line. Thus, tube 206 contacts the release pin 400 in the grooves 410, 412 respectively. As a result, the tube 206 and the entire top member 200 drops to a lower height (second height). The height difference between the first height and the second height equals to the depth of the grooves 410, 412. The release pin 400 may be actuated and moved from the first position to the second position by striking an end of the cylindrical body 402.

In one embodiment, support head 100 may have a total height of about 50 cm when assembled.

In use, support heads 100 are mounted on support posts 30, at the top end of the top section 36, by the latching mechanism in the base member 300. The release pin 400 in each support head 100 is set at the first (initial) position to prop the top member 200 to the higher first height. Beams 20 are mounted on top of the support head 100 at the hook plates 210, directly or indirectly. Forming panels 40 are next installed and supported by the beams 20, and then liquid concrete is poured onto the forming panels 40 and cured to form concrete slabs.

The cured concrete slabs may now be supported by the structure in which the concrete slabs are formed, such as building walls or posts (not shown) below the concrete labs, or some other more permanent structural supports (not shown) used to support the structure to be constructed, as can be understood by those skilled in art. Therefore, it is no longer necessary to use the support posts 30 to support the forming panels 40 or the concrete slabs.

Thus, after the concrete has been cured and the formed solid concrete slabs are supported by some other support structures, a user may manually strike each release pin 400 with a striking tool such as a hammer, to move the pin 400 from the first (initial) position to the second (release) position. Consequently, the top member 200 in each support head 100 drops down to the second (lower) height, thus releasing or reducing the weight load on the support post 30 below, which load was applied by the concrete slabs supported by the beams 20, including the weights of the supported items and any compression force generated by expansion of the concrete during curing. The support posts 30 can thereafter be conveniently removed.

As now can be appreciated, the support head with a release pin as described above has a simple construction and provides a convenient way to release the vertical load applied to the support head and the support post on which the support head is mounted.

Various modifications may be made to the specific embodiments shown in the drawings, and alternative or optional features may be added or omitted in different embodiments.

For example, in some embodiments, the release pin may have different spaced apart depressions on the elongated body 402, in place of the grooves 410, 412, and provide the same effect of lowering the top member 200. The depressions in the pin may be spaced apart so that they match the distance between the pin holes 202, 204. In some embodiments, the depressions may face upwards when the pin is installed in place in the pin holes 202, 204, 302, 304. In some embodiments, the depressions may face downwards, in which case the depressions may be spaced apart to match the distance between pin holes 302, 304. The depressions may be present on only one side of the pin body, or may extend around the pin body thus forming an annular groove, channel, or slot in the pin body. The grooves 410, 412 or depressions in the pin body may have tapered edges to allow smooth transition and sliding movement of the pin in the pin holes when the pin is moved from the first position to the second position.

In some embodiments, the telescopic tubes of support head 100 may be replaced with matching opposing walls. In particular, a support head may include a base member configured to couple to a support post and a top member having at least one arm or peg for supporting a beam thereon. The base member includes opposing walls extending upwardly. The top member has opposing walls extending downwardly. Each of the opposing walls in the top and base members has a pin hole thereon, and the opposing walls and the pin holes are spaced and arranged such that the pin holes in the opposing walls are aligned along a horizontal axis. A pin is slidably received in the pin holes. The pin has a longitudinal axis aligned with the horizontal axis of the pin holes and has depressions extending transversal to the longitudinal axis. The pin is slidably moveable within the pin holes from a first position to a second position such that in the first position, the depressions are offset from the opposing walls and the top member is supported by the pin at a first, higher height, and in the second position, the depressions are aligned with the opposing walls and the top member is supported by the pin at a second, lower height. In some embodiments, the opposing walls may be structured in various manners and it is not necessary to use these opposing walls to align and orient the top and base members.

In some embodiments, a support head may include a base member and a top member movably coupled to the base member. The base member is configured to configured to couple to a support post in formwork system and has a vertically extending section with a pin hole. The top member includes at least one arm for supporting thereon one or more beams of the formwork system, directly or indirectly. The top member also has a vertically extending section with a pin hole aligned with the pin hole of the vertically extending section of the base member. The support head further includes a release pin, such as release pin 400, which is slidably received in the pin holes of the base member and the stop member. The release pin is supported by the base member, and the top member is supported by the release pin. The release pin has a longitudinal axis and at least one groove extending transversal to the longitudinal axis. The release pin is slidably moveable within the pin holes from a first position to a second position such that in the first position the top member contacts the release pin outside the at least one groove and is at a first, higher height, and in the second position the top member contacts the release pin in the at least one groove and is at a second, lower height. In some embodiments, the vertically extending sections of the top member and the base member may both be in the form of tubes. In some embodiments, a vertically extending section may include two opposing walls extending from a horizontal base plate, which may not form a closed tube. In some embodiments, the vertically extending section of the top member may be a solid post with a horizontal through hole, and the post may have a width or diameter that can fit inside the groove on the release pin. In some embodiments, the vertically extending sections of both the base member and the top member may be tubes, but the tube of the top member may be larger than the tube of the base member so that the tube of the base member may be slidably received inside the tube of the top member. In any embodiment, the groove(s) on the release pin should be positioned and sized to match the vertically extending section of the top member so the top member can be supported either outside the groove(s) of the release pin or inside the groove(s) of the release pin. The groove(s) of the release pin may have a generally U-shaped or V-shaped profile.

In the specific embodiment illustrated in the drawings, each hook plate 210 of the top member 200 includes a support arm 212, which has inclined surfaces 213 and 214 and a level surface 216 between the inclined surfaces 213, 214 that define a saddle in the support arm 212. One of the support arms 212 may have two saddles positioned on opposite ends of the arm 212. The other hook plate 210 may have one saddle. In some embodiments, the angle between the inclined surfaces 213, 214 and the top surface of the main plate 220 may vary from about 30 degrees to about 90 degrees.

As can be appreciated, in use, an end portion of a beam 20, such as a mounting pin (not separately shown), may be received in and ride on a saddle of support arm 212, and the inclined surfaces 213, 214 may restrict the lateral movement of the beam 20, which can be of different sizes, thus stabilizing the beam 20.

In some embodiments a support post 30 may also be used to support a compensation-strip (not shown) which may be used to fill gaps between forming panels 40.

In an embodiment, some components of support head 100 may be made of a metallic material, such as steel. Other materials such as aluminum may also be used. The components in the top member 200 may be secured to one another by welding.

As noted above, in some embodiments, beams 20 may include mounting pins (not separately shown) and the beams 20 may be mounted on the support heads through the mounting pins. In some situations, an end of a beam 20 or some other item to be supported may be supported by a peg 250, typically temporarily.

The vertical tubes 206 and 320 are shown to have a generally square profile with rounded corners, but they may have different shapes in different embodiments. For example, the vertical tubes may have matching circular, oval, or other polygonal profiles, as long as the tubes can provide positioning and orienting functions for the top member 200, and provide a channel for the release pin 400 to be positioned in the set (first) position and the release (second) position as described here.

Of course, the above described embodiments are intended to be illustrative only and in no way limiting. The described embodiments are susceptible to many modifications of form, arrangement of parts, details, and order of operation. The invention is intended to encompass all such modification within its scope, as defined by the claims.

What is claimed:

1. A support head mountable on a support post for supporting a beam in a formwork system, the support head comprising:

a top member configured for contacting and supporting the beam, comprising a first tube having opposing pin holes;

a base member mountable on top of the support post, comprising a base plate, a latch mounted below the base plate configured for engaging the support post, and a second tube having opposing pin holes and extending upward from the base plate, wherein the first and second tubes are configured to form vertically extending telescopic tubes with the pin holes aligned along a horizontal axis; and a pin insertable into the pin holes, the pin comprising spaced apart depressions thereon and being slidably moveable in the pin holes from a first position to a second position, wherein, in the first position the depressions are offset from the pin holes, and in the second position the depressions are aligned with the respective pin holes thus lowering the first tube and the top member in height.

2. A support head comprising:

a base member configured to couple to a support post, the base member comprising opposing walls extending upwardly;

a top member comprising at least one arm or peg configured for supporting a beam thereon and opposing walls extending downwardly;

wherein each one of the opposing walls has a pin hole thereon and the pin holes in the opposing walls are aligned along a horizontal axis; and a pin slidably received in the pin holes, the pin having a longitudinal axis aligned with the horizontal axis and comprising depressions extending transversal to the longitudinal axis, wherein the pin is slidably moveable within the pin holes from a first position to a second position such that in the first position, the depressions are offset from the opposing walls and the top member is supported by the pin at a first, higher height, and in the second position, the depressions are aligned with the opposing walls and the top member is supported by the pin at a second, lower height, wherein a first end of the pin comprises a guide portion and the top member comprises a pair of guide plates configured for receiving the guide portion to orient the pin and prevent rotation of the pin, wherein the guide portion restricts axial movement of the pin in the pin holes and prevents disengagement of the pin from the pin holes at the first end.

3. The support head of claim 2, wherein the base member comprises an upwardly extending tube and the top member comprises a downwardly extending tube, the tubes forming a pair of telescopic tubes, and wherein the opposing walls are walls in the corresponding tubes.

4. A support head mountable on a support post for supporting a beam in a formwork system, the support head comprising:

a top member configured for contacting and supporting the beam, comprising a first tube having opposing pin holes;

a base member mountable on top of the support post, comprising a second tube having opposing pin holes, wherein the first and second tubes are configured to form vertically extending telescopic tubes with the pin holes aligned along a horizontal axis; and a pin insertable into the pin holes, the pin comprising spaced apart depressions thereon and being slidably moveable in the pin holes from a first position to a second position, wherein, in the first position the depressions are offset from the pin holes, and in the second position the depressions are aligned with the respective pin holes thus lowering the first tube and the top member in height, wherein a first end of the pin comprises a guide portion and the top member comprises a pair of guide plates configured for receiving the guide portion to orient the pin and prevent rotation of the pin, wherein the guide portion restricts axial movement of the pin in the pin holes and prevents disengagement of the pin from the pin holes at the first end.

5. The support head of claim 4, wherein the pin comprises an elongated, substantially cylindrical body having a flat surface opposite to the depressions.

6. The support head of claim 4, further comprising a cotter pin, wherein a second end of the pin comprises a pin hole for receiving the cotter pin, and wherein the cotter pin when received in the pin hole of the release pin restricts axial movement of the pin and prevents disengagement of the pin from the pin holes at the second end.

7. The support head of claim 4, wherein the pin is made of steel.

8. The support head of claim 4, wherein the pin has an electroplated surface.

9. The support head of claim 4, wherein the top member comprises a main plate and at least one of a support arm and a support peg on top of the main plate, wherein the first tube extends downward from the main plate.

10. The support head of claim 4, wherein the base member comprises a base plate and a latch mounted below the base plate for engaging the support post, wherein the second tube extends upward from the base plate.

11. The support head of claim 4, wherein the depressions of the pin face upwards when the pin is in the first and second positions.

12. The support head of claim 4, wherein the depressions comprise a pair of spaced apart grooves.

13. The support head of claim 12, wherein each one of the grooves has a substantially U-shaped profile.

14. The support head of claim 12, wherein each one of the grooves has a substantially V-shaped profile.

15. The support head of claim 12, wherein the grooves have a depth of about 5 mm.

16. The support head of claim 12, wherein the grooves have a width of about 10 mm.

17. A vertical support fora formwork system, comprising a support post and the support head of claim 4 mounted on top of the support post.

18. A formwork system comprising a plurality of vertical supports, at least one of the vertical supports comprising the vertical support of claim 17.

19. The formwork system of claim 18, further comprising a plurality of beams, each one of the beams supported by at least two of the vertical supports through support heads thereof.

20. A method of supporting formwork panels with the formwork system of claim 19, comprising:

setting the pin in each one of the support heads of the formwork system at the first position;

disposing one or more formwork panels on the beams of the formwork system;

forming concrete slabs on the formwork panels;

striking the pin in a first support head to move the pin to the second position so as to lower the top member of the first support head and an end of the beam supported thereon, thus releasing a vertical load applied onto the support post below the first support head to allow removal of the support post.

* * * * *